US006177784B1

(12) United States Patent
Choy

(10) Patent No.: US 6,177,784 B1
(45) Date of Patent: Jan. 23, 2001

(54) LARGE SIGNAL GAIN MODIFIER CIRCUIT

(75) Inventor: Winnie W. Choy, Cerritos, CA (US)

(73) Assignee: Hughes Electronics Corporation, El Segundo, CA (US)

( * ) Notice: Under 35 U.S.C. 154(b), the term of this patent shall be extended for 0 days.

(21) Appl. No.: 09/377,439

(22) Filed: Aug. 19, 1999

(51) Int. Cl.[7] ..... G05F 1/56
(52) U.S. Cl. ..... 323/280; 323/276
(58) Field of Search ..... 323/276, 280, 323/282, 299, 303, 349, 351; 330/278, 279

(56) References Cited

U.S. PATENT DOCUMENTS 3,967,219 * 6/1976 Dolby ..... 333/14
5,777,866 * 7/1998 Jacobs et al. ..... 363/126
6,009,000 * 12/1999 Siri ..... 363/21

* cited by examiner

*Primary Examiner*—Jessica Han
(74) *Attorney, Agent, or Firm*—Terje Gudmestad

(57) ABSTRACT

A diode-resistor network for modifying the gain/bandwidth of the feedback loop. The feedback loop gain modifier circuit comprises two (2) diodes and a resistor coupled and parallel with a resistor in the AC feedback path of an amplifier. The diodes are connected such that one diode conducts on a voltage bus overshoot and the other diode conducts on a voltage bus undershoot. In this manner, during large step load transients, one of the gain modifier circuits diodes conducts thereby coupling the resistors in parallel resulting in a modified the gain/bandwidth of the feedback loop. In this way, the feedback gain modifier circuit does not affect the small signal feedback loop stability because it is only activated when a large transient is present.

10 Claims, 2 Drawing Sheets

LARGE SIGNAL GAIN MODIFIER CIRCUIT

TECHNICAL FIELD

The present invention relates to feedback circuits for error amplifiers requiring fast transient response and, more particularly, to a gain modifier circuit for reducing voltage transients due to large step loads commonly associated with communications satellites having time division multiple access (TDMA) operation.

BACKGROUND OF THE INVENTION

Communications satellites with TDMA operation often experience significant bus voltage transients induced by repetitive large step load increases or decreases. These load transients can occur when, for example, a satellite having at least two power sources switches from using one source such as a solar array to another source such as a battery. Currently, to reduce the effects of the transient voltages, the gain/bandwidth of the feedback loop is increased to improve the power controller response time.

There are several disadvantages associated with the conventional scheme of increasing the feedback loop gain or bandwidth. Specifically, there are limitations on how much the feedback loop gain or bandwidth can be increased without impacting feedback loop stability. The amount of feedback loop gain/bandwidth is usually limited by the L-C comer of the power converter, the right half-plane zero, and the power converter switching frequency. In addition, to significantly increase the gain/bandwidth of the feedback loop, the feedback compensation is often complicated. For example, average current mode control may be necessary to increase the loop gain.

DISCLOSURE OF THE INVENTION

Accordingly, it is an object of the present invention to provide an improved feedback loop gain control circuit having improved stability and response time.

According to the present invention, the foregoing and other objects and advantages are attained by a feedback loop gain modifier circuit comprising two (2) diodes and a resistor coupled and parallel with a resistor in the AC feedback path of an amplifier. The diodes are connected such that one diode conducts on a voltage bus overshoot and the other diode conducts on a voltage bus undershoot. In this manner, during large step load transients, one of the gain modifier circuits diodes conducts thereby coupling the resistors in parallel resulting in a modified the gain/bandwidth of the feedback loop.

An advantage of the present invention is that the feedback gain modifier circuit does not affect small signal feedback loop stability because it is only activated when a large transient is present. In other words, the feedback loop can be stable in a large signal sense while the small signal loop stability is not affected, due to the non-linearity of the converter loop gain between small and large signals. Another advantage is that the feedback gain modifier circuit is a simple diode-resistor network. In addition, although the feedback gain modifier circuit is located in the bus voltage sense path, it does not affect the DC operating point of the power converter.

Other objects and advantages of the invention will become apparent upon reading the following detailed description and appended claims, and upon reference to the accompanying drawings.

BRIEF DESCRIPTION OF THE DRAWINGS

For a more complete understanding of this invention, reference should now be had to the embodiments illustrated in greater detail in the accompanying drawings and described below by way of examples of the invention. In the drawings.

DETAILED DESCRIPTION OF THE INVENTION

Figure 1:
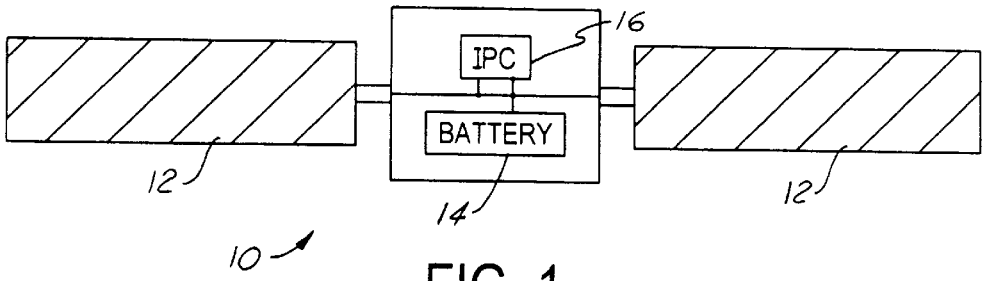
FIG. 1 is a schematic diagram of a communication satellite having TDMA operation.

Referring to FIGS. 1, there is shown a schematic diagram of a communication satellite 10 having TDMA operation. In this example, the satellite 10 includes at least two (2) independent power sources; namely, the solar array 12 and a battery source 14. An integrated power controller (IPC) 16 manages the power sources 12, 14 to regulate the DC operational bus voltage of the satellite 10. Depending upon the operational tasks of the satellite 10, there may be a need to switch from one power source such as the solar array 12 to the other power source such as the battery 14, and vice versa. During these power source switches, large transient voltages can appear on the operational voltage bus of the satellite 10. The large voltage transients can also occur while operating from the same power source. This can have an undesirable affect on the other components of the satellite 10 which are powered by the voltage bus.

Figure 2:
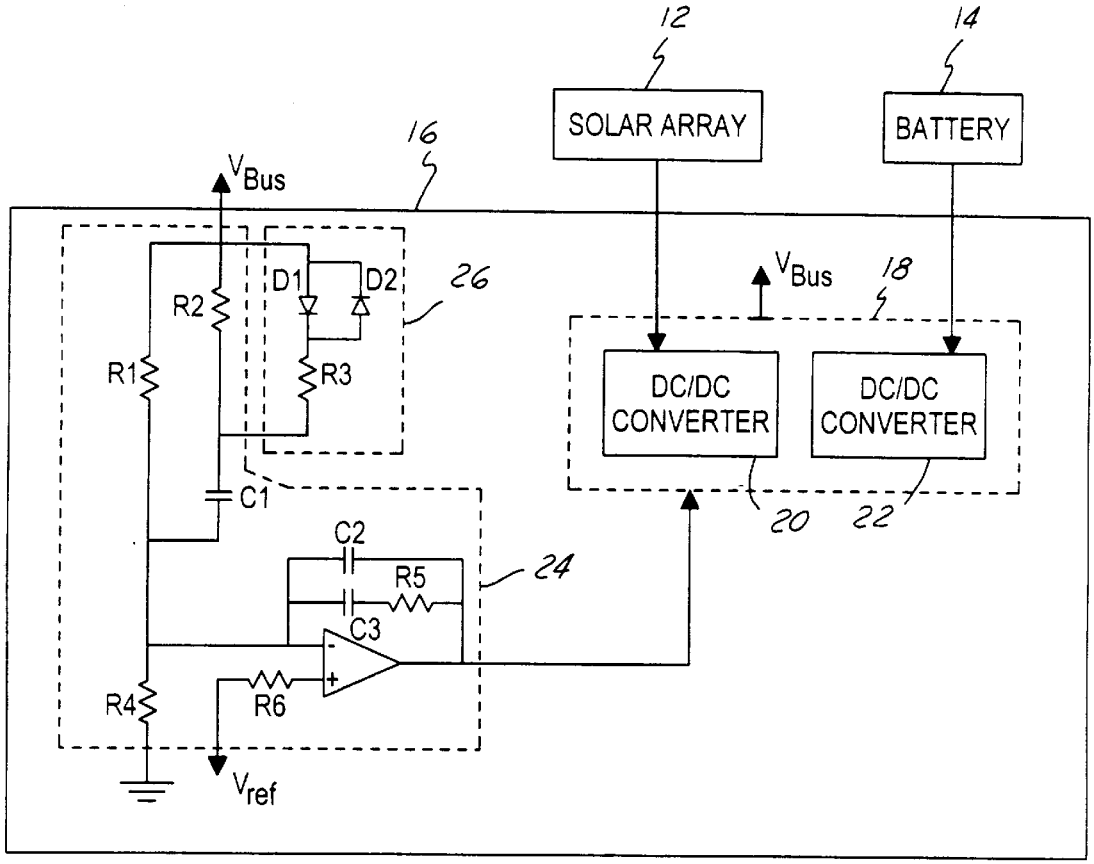
FIG. 2 is a schematic diagram of one embodiment of the feedback gain modifier circuit according to the present invention.

Referring to FIG. 2, there is shown one embodiment of the feedback gain modifier circuit of the present invention in operational relationship to the IPC 16 of FIG. 1. As shown in FIG. 2, the power converter including a switching power supply 18 having two groups of DC/DC converters 20, 22 to regulate a DC bus. One group of converters 20 regulates the bus with the solar array 12 as the source, while the other group of converters 22 supports any excessive load with the batter 14 as the source. An amplifier 24 (shown here as a type 3 error amplifier) provides an error signal to the switching power supply 18 to correct voltage transients occurring on the voltage bus. The output of the error amplifier 24 regulates the duty cycle of the switching power supply 18 to drive the bus voltage toward its regulated set point. The gain of the error amplifier 24 is directly related to the component values in the feedback circuit which is defined as R1, R2 and C1.

The feedback gain modifier circuit 26 is coupled to the resistor R2 of the feedback circuit for the error amplifier 24. The feedback gain modifier circuit 26 comprises a resistor R3 connected in series with two parallel-connected diodes D1, D2 having the opposite polarity such that when one of the diodes is conducting, the other diode is off.

In operation, when small voltage transients appear on the bus which are insufficient to activate either D1 or D2, the feedback gain modifier circuit will behave as an open circuit and not affect the small signal loop stability of the error amplifier 24. In the presence of a large voltage transient on the bus, however, one of the two diodes D1, D2 will conduct. For example, when the bus voltage drops below its DC set point by more than one diode drop, the diode D2 will conduct and the resistor R3 will effectively be coupled in parallel with the resistor R2. If R3 has a value less than R2, the RC time constant associated with charging the capacitor C1 will be reduced and allow more current to change the voltage in the capacitor C1. As a result, the gain of the feedback circuit is increased and the error amplifier will produce an error signal to correct the voltage transient sooner, thus reducing the amplitude of the transient voltage.

During a large step load decrease, the bus voltage will increase by more than one diode drop, and the diode D1 will conduct. This, again, will effectively connect the resistors R2, R3 in parallel. Preferably, the resistor R3 has a value less than the resistor R2. This results in a reduced RC time constant thereby allowing more current to change the voltage in the capacitor C1. Because the bus voltage is high, the error amplifier will produce an error signal to reduce the duty cycle of the switching power supply 18 to bring the bus voltage rapidly down towards its set point. In addition, the diodes D1, D2 are preferably fast signal diodes.

Figure 3A:
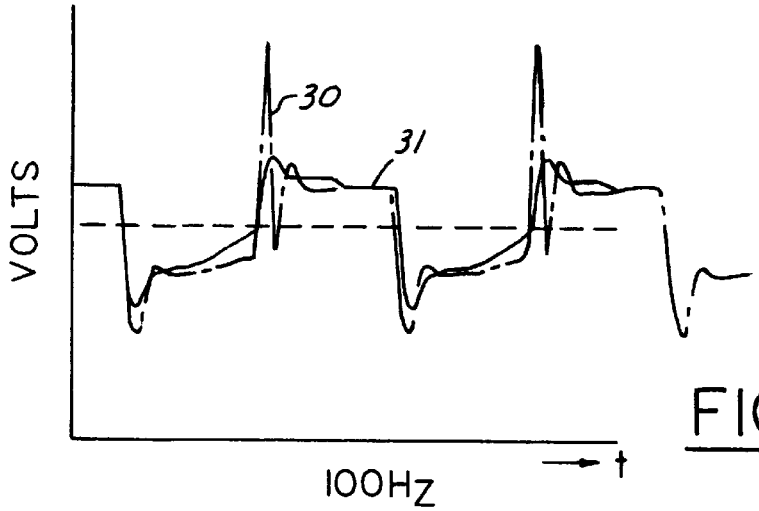
FIGS. 3A–3C are graphs representing the transient response in a system with and without the feedback gain modifier circuit of the present invention.
Figure 3B:
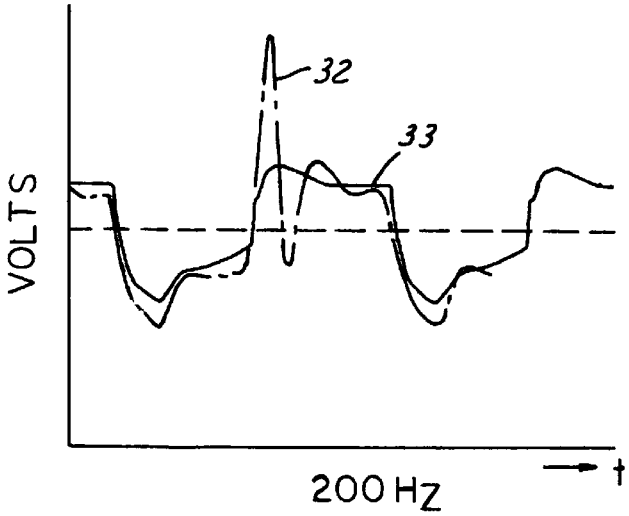
Figure 3C:
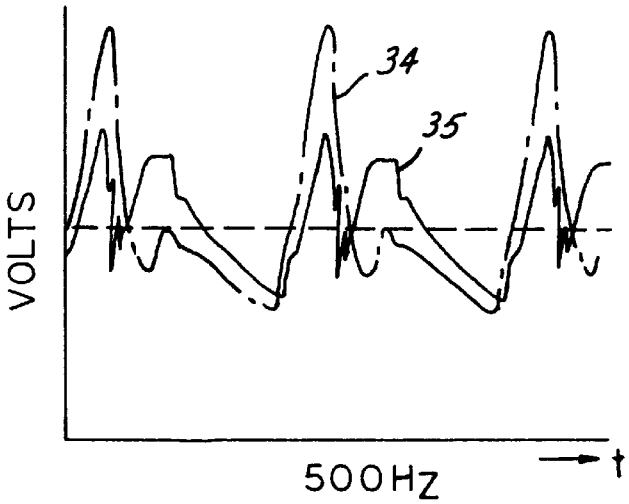

FIGS. 3A, 3B and 3C are a series of graphs depicting the IPC transient response with and without the feedback gain modifier circuit for three separate frequencies. In these examples, the voltage transients correspond to changes in the bus voltage due to a switch from solar array power to a battery charge mode. The following table indicates the component values for the circuit of FIG. 2 which resulted in the graphs of FIGS. 3*a*–3*c:*

$V_{Bus}$=100v

R1=100 kΩ

R2=50 kΩ

R3=10 kΩ

R4=5 kΩ

R5=20 kΩ

R6=4 kΩ

C1=0.01 μF

C2=100 μF

C3=0.01 μF

In the Figures, lines 30, 32, 34 represent the IPC transient response during the mode change at 100 Hz, 200 Hz, and 500 Hz, respectively, without the feedback gain modifier circuit. Lines 31, 33, 35 represent the IPC transient response during the same mode changes with the feedback gain modifier circuit 26 for the same frequencies. As can be appreciated in FIGS. 3A–3C, the benefit of the feedback gain modifier circuit 26 is substantial when a large voltage transient is present.

From the foregoing, it will be seen that there has been brought to the art a new and improved feedback gain modifier circuit which improves the bus voltage transient response due to a large step load without impacting the small signal feedback loop stability. In addition, although the feedback gain modifier circuit is located in the bus voltage sense path, it does not affect the DC operative point of the switching power supply 18.

While the invention has been described in connection with one or more embodiments, it will be understood that the invention is not limited to those embodiments. On the contrary, the invention covers all alternatives, modifications, and equivalents, as may be included within the spirit and scope of the appended claims.

What is claimed is:

1. A voltage regulator circuit for controlling the regulation of a switching power supply comprising:

an error amplifier for providing a control signal to said switching power supply;

a feedback circuit connected between an input to said error amplifier and the voltage to be regulated by said switching power supply, said feedback circuit providing the gain for said error amplifier and wherein said feedback circuit comprises a first resistor connected in parallel with a series-coupled second resistor and capacitor; and a gain modifier circuit coupled to said feedback circuit for modifying the gain of said error amplifier during large voltage transients wherein said gain modifier circuit is coupled in parallel with said second resistor.

2. The voltage regulator circuit of claim 1 wherein said gain modifier circuit comprises a third resistor coupled in series with two parallel-coupled diodes, said diodes being connected such that one diode conducts on a voltage bus overshoot and one diode conducts on a voltage bus undershoot.

3. The voltage regulator circuit of claim 2 wherein said third resistor has a value less than said second resistor.

4. The voltage regulator circuit of claim 2 wherein said diodes are fast signal diodes.

5. A gain modifier circuit comprising a first resistor connected in series with two parallel coupled diodes, said diodes being connected such that when one diode is conducting the other diode is off, said gain modifier circuit being connected in parallel with a second resistor of a feedback gain circuit, said feedback gain circuit being coupled between an input to an amplifier and a voltage source such that during large voltage transients one of the gain modifier circuit diodes conducts, thereby coupling said first resistor and second resistor in parallel and modifying the gain of said feedback gain circuit.

6. The gain modifier circuit of claim 5 wherein said first resistor has a value less than said second resistor.

7. The gain modifier circuit of claim 5 wherein said diodes are fast signal diodes.

8. A method of modifying the gain of an amplifier in the presence of large voltage transients comprising the step of selectively coupling a first resistor in parallel to a second resistor located in the feedback gain circuit of said amplifier in the presence of large voltage transients.

9. The method as set forth in claim 8 wherein the step of selectively coupling a first resistor in parallel to a second resistor located in the feedback gain circuit of said amplifier includes the step of activating a diode connected in series with said first resistor.

10. The method as set forth in claim 8 wherein the step of selectively coupling a first resistor in parallel to a second resistor located in the feedback gain circuit of said amplifier includes the step of activating a first diode connected in series with said first resistor in the presence of a large positive voltage transient, and activating a second diode connected series with said first resistor in the presence of a large negative voltage transient.

* * * * *